US007383811B2

(12) United States Patent
Ueda

(10) Patent No.: US 7,383,811 B2
(45) Date of Patent: Jun. 10, 2008

(54) FUEL INJECTION SYSTEM FOR ENGINE

(75) Inventor: Hiroya Ueda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/641,012

(22) Filed: Dec. 19, 2006

(65) Prior Publication Data

US 2007/0144491 A1 Jun. 28, 2007

(30) Foreign Application Priority Data

Dec. 28, 2005 (JP) ..... 2005-377030

(51) Int. Cl.
*F02B 3/00* (2006.01)

(52) U.S. Cl. ..... 123/299; 123/304

(58) Field of Classification Search ..... 123/299, 123/300, 304, 456, 575, 576, 577, 578, 179.17, 123/184.34, 184.35
See application file for complete search history.

(56) References Cited

U.S. PATENT DOCUMENTS 3,868,936 A * 3/1975 Rivere ..... 123/445
4,347,822 A * 9/1982 Casey ..... 123/445
4,495,930 A * 1/1985 Nakajima ..... 123/575
5,284,117 A * 2/1994 Akase ..... 123/445
6,039,029 A * 3/2000 Nagasaka et al. ..... 123/442
6,196,186 B1 * 3/2001 Nagasaka et al. ..... 123/336
7,066,135 B2 * 6/2006 Ishikawa et al. ..... 123/198 E
2005/0066926 A1 * 3/2005 Ishikawa et al. ..... 123/184.34
2005/0274353 A1 * 12/2005 Okubo et al. ..... 123/299
2006/0000455 A1 * 1/2006 Kurata et al. ..... 123/514

FOREIGN PATENT DOCUMENTS

JP 2004-100633 A 4/2004

* cited by examiner

*Primary Examiner*—Carl S Miller
(74) *Attorney, Agent, or Firm*—Westerman, Hattori, Daniels & Adrian, LLP.

(57) ABSTRACT

A fuel injection system for an engine is configured of a downstream-side fuel injection valve which is provided to an intake passage connected to a combustion chamber, and from which fuel in the intake passage is injected, and an upstream-side fuel injection valve which is provided in the intake passage upstream of the downstream-side fuel injection valve, and from which fuel in the intake passage is injected. In the fuel injection system, a fuel injection pressure applied to the upstream-side fuel injection valve is set at a higher value than a fuel injection pressure applied to the downstream-side fuel injection valve. Fuel is injected from both injection valves on fuel injection shares depending on a detected load on the engine.

7 Claims, 7 Drawing Sheets

FUEL INJECTION SYSTEM FOR ENGINE

FIELD OF INVENTION

The present invention relates to a fuel injection system used for an engine of a motorcycle or the like.

BACKGROUND OF THE INVENTION

A fuel injection system used for an engine of a motorcycle or the like is typically includes a fuel pump for supplying fuel under pressure, a regulator for keeping the pressure of fuel (fuel pressure) constant, a fuel injection valve from which fuel in an intake passage (or pipe) is injected, the intake passage joined to a combustion chamber of an engine, an electronic control unit (ECU) that is operation control means for the fuel injection valve, and the like. In such a system, the electronic control unit determines an air-fuel ratio at which the most effective combustion condition is achieved, based on information such as an accelerator opening degree, an engine RPM (revolutions per minute), and an intake air amount, and causes fuel to be injected in the amount necessary to achieve such an air-fuel ratio from the fuel injection valve.

Furthermore, another fuel injection system is known as an improved version of the above-described fuel injection system. In such a system, fuel injection valves are provided in the intake passage on the upstream side and downstream side thereof, respectively. Both of these fuel injection valves are connected in series with a fuel pipe joined to a fuel tank. With this configuration, while fuel is constantly injected from the fuel injection valve provided on the downstream side of the intake passage, fuel is also injected from the fuel injection valve provided on the upstream side of the intake passage when an engine load is increased (e.g., Japanese Patent Application Laid-open No. 2004-100633 (JP '633).) It has been known that the fuel injected from the fuel injection valve provided on the upstream side of the intake passage is improved in volumetric efficiency, since heat is taken from intake air when the fuel is vaporized. Accordingly, the fuel injection system with this configuration makes it possible to improve the output of an engine (See, for example, JP '633).

However, in a case where the fuel injection valves are provided on both of the upstream and downstream sides of the intake passage as described above, the distance between the fuel injection valve provided on the upstream side of the intake passage and a combustion chamber is greater than that between the fuel injection valve provided on the downstream side of the intake passage and the combustion chamber. As a result, the fuel injected from the fuel injection valve on the upstream side reaches the inside of the combustion chamber after the fuel injected from the fuel injection valve on the downstream side reaches. For this reason, in order to supply fuel in the whole amount required to the combustion chamber within a period of time in an intake stroke, it is necessary to make the amount of fuel injected from the downstream side larger than that of fuel injected from the upstream side. This brings about a problem that an effect obtained by additionally providing the fuel injection valve on the upstream side of the intake passage is not sufficiently produced.

SUMMARY OF THE INVENTION

The present invention has been made in view of the above-described problem. One object of the present invention is to provide a fuel injection system for an engine having a structure capable of improving the performance of an engine provided with fuel injection valves on both of the upstream and downstream sides of the intake passage.

A fuel injection system for an engine of the present invention is configured of a downstream-side fuel injection valve and an upstream-side fuel injection valve. The downstream-side fuel injection valve is provided in an intake passage connected to a combustion chamber of an engine, and fuel in the intake passage is injected from the downstream-side fuel injection valve. The upstream-side fuel injection valve is provided in the intake passage upstream of the downstream-side fuel injection valve, and fuel in the intake passage is injected from the upstream-side fuel injection valve. In the fuel injection system for an engine, a fuel injection pressure applied to the upstream-side fuel injection valve is set at a higher value than a fuel injection pressure applied to the downstream-side fuel injection valve.

The above-described fuel injection system for an engine includes control means (for example, an electronic control unit 90 described in an embodiment) and an engine load detecting means. The control means controls injections of fuel by using the downstream-side fuel injection valve and the upstream-side fuel injection valve. The engine load detecting means detects a load on the engine. It is preferred that the control means cause fuel to be injected from the downstream-side fuel injection valve and the upstream-side fuel injection valve on the respective fuel injection shares corresponding to the load on the engine detected by the engine load detecting means. In this case, it is preferred that the control means increase the fuel injection share of the upstream-side fuel injection valve as the load on the engine detected by the engine load detecting means increases. Here, the fuel injection share denotes the ratio of the shared amount of fuel to the amount of fuel to be supplied to the combustion chamber, the shared amount of fuel being injected by each of the downstream-side fuel injection valve and the upstream-side fuel injection valve.

The fuel injection system includes a throttle valve for regulating the amount of air to be taken in the combustion chamber, and a throttle opening degree detecting means (for example, a throttle opening degree sensor 91) for detecting the opening degree of the throttle valve. In addition, the engine load detecting means includes at least the throttle opening degree detecting means. It is preferred that the control means set the fuel injection share of the upstream-side fuel injection valve at 0% when the throttle opening degree detecting means detects that the throttle valve is in a fully closed state. On the other hand, it is preferred that the control means set the fuel injection share of the upstream-side fuel injection valve at 100% when the throttle opening degree detecting means detects that the throttle valve is in a fully open state. Here, the throttle valve is preferably disposed between the downstream-side fuel injection valve and the upstream-side fuel injection valve.

Furthermore, it is preferred that a fuel pump for supplying fuel under pressure to the downstream-side fuel injection valve and the upstream-side fuel injection valve includes a first fuel pump and a second fuel pump. The first fuel pump supplies the fuel in a fuel tank under pressure to the downstream-side fuel injection valve. The second fuel pump supplies the fuel to the upstream-side fuel injection valve under pressure, the fuel being supplied under pressure to the downstream-side fuel injection valve by the first fuel pump.

In the fuel injection system of the present invention, a fuel injection pressure applied to the upstream-side fuel injection valve is set at a higher value than a fuel injection pressure applied to the downstream-side fuel injection valve. As a result, a time required for fuel injected from the upstream-side fuel injection valve to reach the combustion chamber can be made equal to or greater than a time required for fuel injected from the downstream-side fuel injection valve to reach the combustion chamber. Thus, the fuel injection share of the upstream-side fuel injection valve can be made greater than that of the downstream-side fuel injection valve if necessary. This makes it possible to realize an engine having higher output than a conventional engine. Furthermore, the fuel injection pressure applied to the upstream-side fuel injection valve can be increased. Thus, a required amount of fuel can be injected in a short time, and a variable region of a timing of fuel injection performed by the upstream-side fuel injection valve can be enlarged. In addition, since it is possible to atomize fuel injected by means of fuel injection under high pressure, volumetric efficiency and combustion efficiency can be enhanced. Consequently, a high output can be achieved.

Here, the fuel injection system for an engine includes control means for controlling injections of fuel from the downstream-side fuel injection valve and the upstream-side fuel injection valve, and engine load detecting means for detecting the load on the engine. The control means causes fuel to be injected from the downstream-side fuel injection valve and the upstream-side fuel injection valve on the respective fuel injection shares depending on the load on the engine which is detected by the engine load detecting means. With this configuration, by setting the fuel injection shares which can produce high output efficiency, it is possible to further increase the output of the engine. In particular, the control means increases the fuel injection share of the upstream-side fuel injection valve as the load on the engine detected by the engine load detecting means increases. With this configuration, when the load is low, highly responsive fuel supply can be achieved by making larger the fuel injection share of the downstream-side fuel injection valves whose distance to the combustion chamber is smaller. Meanwhile, when the load is high, high output is produced by making larger the fuel injection share of the upstream-side fuel injection valves having higher volumetric efficiency and combustion efficiency.

In addition, the fuel injection system includes a throttle valve for regulating the amount of air to be taken in the combustion chamber, and a throttle opening degree detecting means for detecting the opening degree of the throttle valve. Here, the engine load detecting means includes at least the throttle opening degree detecting means. When the throttle opening degree detecting means detects that the throttle valve is in a fully closed state, the control means sets the fuel injection share of the upstream-side fuel injection valve at 0%. With this setting, it becomes unnecessary to activate the second fuel pump when the engine is at low load (e.g., at a time of starting the engine), that is, when the amount of fuel to be supplied to the combustion chamber is small. This makes it possible to enhance starting performance by saving the load (power), and to miniaturize a staring device.

Furthermore, the control means sets the fuel injection share of the upstream-side fuel injection valve at 100%, when the throttle opening degree detecting means detects that the throttle valve is in a fully open state. With this setting, the fuel is not injected from the downstream-side fuel injection valve when the engine is at high load. Accordingly, atomization performance is enhanced, and an output of the engine is increased. In addition, when the engine is at high load, a fuel injection pressure applied to the upstream-side fuel injection valve is high. As a result, the fuel to be supplied to the combustion chamber can be supplied in a sufficient amount only from the upstream-side fuel injection valves to the combustion chamber.

Moreover, the throttle valve is disposed between the downstream-side fuel injection valve and the upstream-side fuel injection valve. In this configuration, the throttle valve is disposed at a position close to the combustion chamber, as compared with a case where the throttle valve 65 is disposed in the intake passage 63 upstream of both of the injection valves. This configuration makes it possible to shorten the length of the intake passage, and to realize an engine with high output/high revolution rate. Since the fuel injection valves (the upstream-side fuel injection valves) are disposed upstream of the throttle valve, the atomization performance of fuel can be enhanced. Here, the fuel injection share of the downstream-side fuel injection valve is controlled in order that the share can become large when the opening degree of the throttle valve is small. Accordingly, the flow of fuel is not blocked by the throttle valve. On the other hand, the fuel injection share of the upstream-side fuel injection valve becomes large when the opening degree of the throttle valve is large. In this case, the flow of fuel is not blocked since the opening degree of the throttle valve itself is also large.

Furthermore, a fuel pump for supplying fuel under pressure to the downstream-side fuel injection valve and the upstream-side fuel injection valve includes a first fuel pump for supplying fuel in a fuel tank to the downstream-side fuel injection valve under pressure, and a second fuel pump for supplying fuel to the upstream-side fuel injection valve under pressure, the fuel being supplied under pressure to the downstream-side fuel injection valve by the first fuel pump. With this configuration, a pressure at which the second fuel pump finally supplies the fuel under pressure is the sum of the supply pressure of the first fuel pump and the supply pressure of the second fuel pump itself. This configuration can easily produce a high pressure required for the upstream-side fuel injection valve. Accordingly, manufacturing costs can be lowered, for example, in comparison to costs of manufacturing a high pressure pump including only the second fuel pump. In addition, in order to realize this configuration it is sufficient to only add a pressure fuel pump equivalent to the second fuel pump to a fuel injection system provided with only one fuel pump. Thus, existing fuel injection systems can be efficiently used.

BRIEF DESCRIPTION OF THE DRAWINGS

A preferred embodiment of the present invention will be described with reference to the accompanying drawings, wherein.

DETAILED DESCRIPTION OF THE INVENTION

Descriptions are given below for a preferred embodiment of the present invention by referring to the accompanying drawings. The words, such as "front," "rear," "left," "right," "up," and "down," which are used in the descriptions here, denotes directions viewed from a driver.

Figure 1:
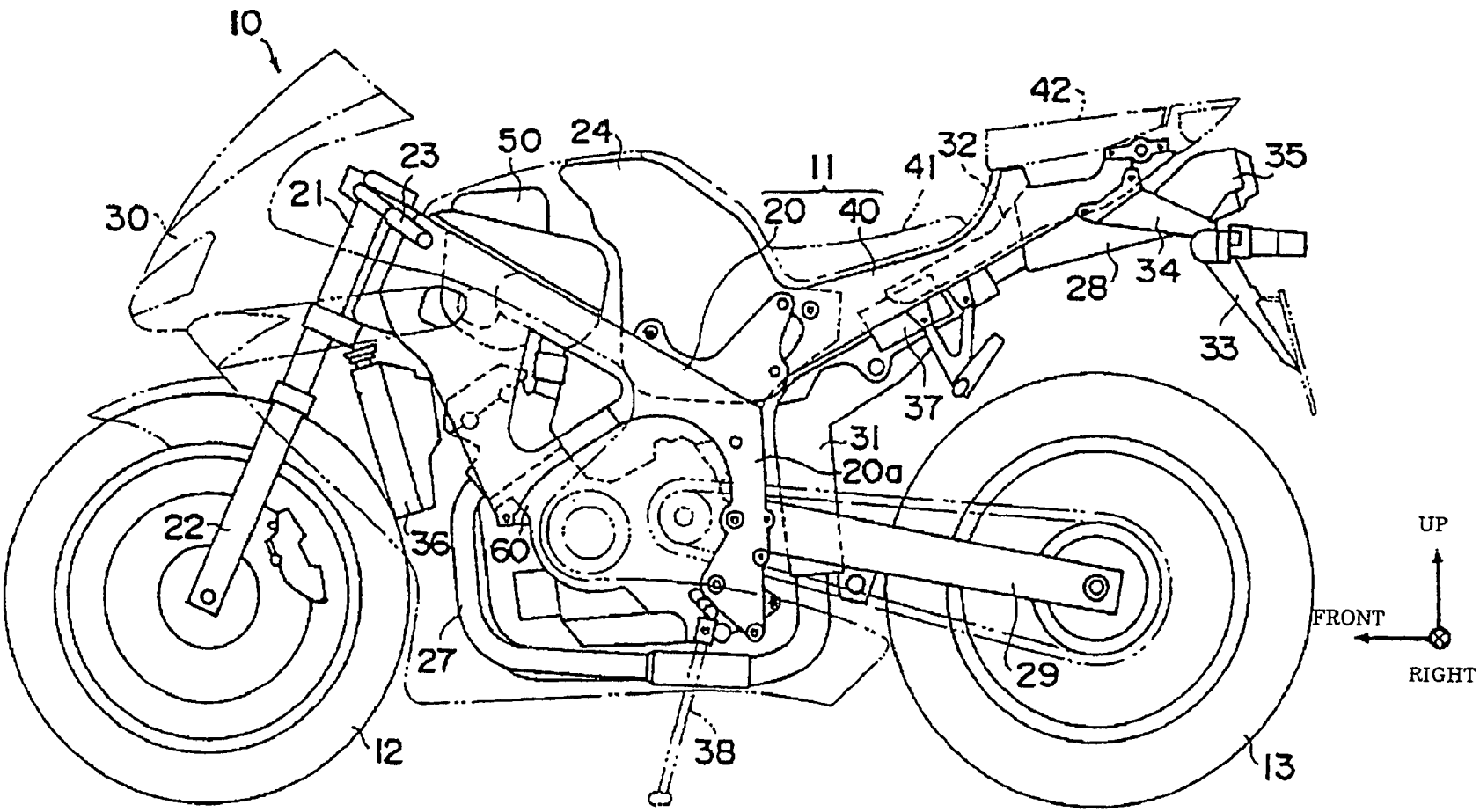
FIG. 1 is a left side elevation view of a motorcycle provided with a fuel injection system for an engine of an embodiment of the present invention.

FIG. 1 is a view showing a motorcycle provided with a fuel injection system for an engine of an embodiment of the present invention. The motorcycle 10 includes a cradle type body frame 20, a front fork 22 attached to a head pipe 21 of the body frame 20, a front wheel 12 attached to the front fork 22, a handlebar 23 connected to the front fork 22, a fuel tank 24 and an air chamber 50 attached to an upper portion of the body frame 20, a seat rail 40 provided in such a way that it extends in the rearward direction from the body frame 20, a front seat 41 and a rear seat 42 attached to the seat rail 40, a four-cylinder engine 60 disposed in a cradle space of the body frame 20, a muffler 28 connected to an exhaust duct 63*b* (refer to FIG. 6) of the engine 60 with an exhaust pipe 27 interposed in between, a swing arm 29 suspending a rear cushion (not shown) on rear portion of the body frame 20, and a rear wheel 13 attached to the swing arm 29. The motorcycle 10 is a full cowling type vehicle in which a vehicle body 11 constituted of vehicle frame 20 and seat rail 40 is covered with a cowl 30 indicated with an imaginary line. The seat rail 40 functions as a rear frame supporting seats (a front seat 41 and a rear seat 42). A driver can sit on the front seat 41 and a passenger can sit on the rear seat 42.

The above-described exhaust pipe 27 is a metal tube having the following structure. The exhaust pipe 27 extends from the exhaust duct 63*b* of the engine 60 in the rearward direction of the body frame 20 passing under the engine 60. After that, the exhaust pipe 27 extends from the rear end of the body frame 20 in the upward direction along the body frame 20, and further extends from the upper end of the body frame 20 up to the muffler 28 along the seat rail 40. A heat shield plate pipe 31 is attached to the exhaust pipe 27 in a way that a portion of the exhaust pipe 27 is covered. A heat shield plate 32 is provided to an upper portion of the muffler 28 so that the upper portion is covered. A stage 34 is provided to a rear portion of the seat rail 40 used for attachment of a rear fender 33. A protector 35 is attached to the stage 34, and covers rear night and rear left portions of the muffler 28. A radiator 36 is provided at a front position of the engine 60 in a way that the radiator 36 extends in the upward to downward directions. A battery 37 is attached to the seat rail 40. A kickstand 38 is attached to a lower end of a lower extended portion 20*a* of the body frame 20 in a way that the kickstand 38 freely moves in the forward and rearward directions.

Figure 2:
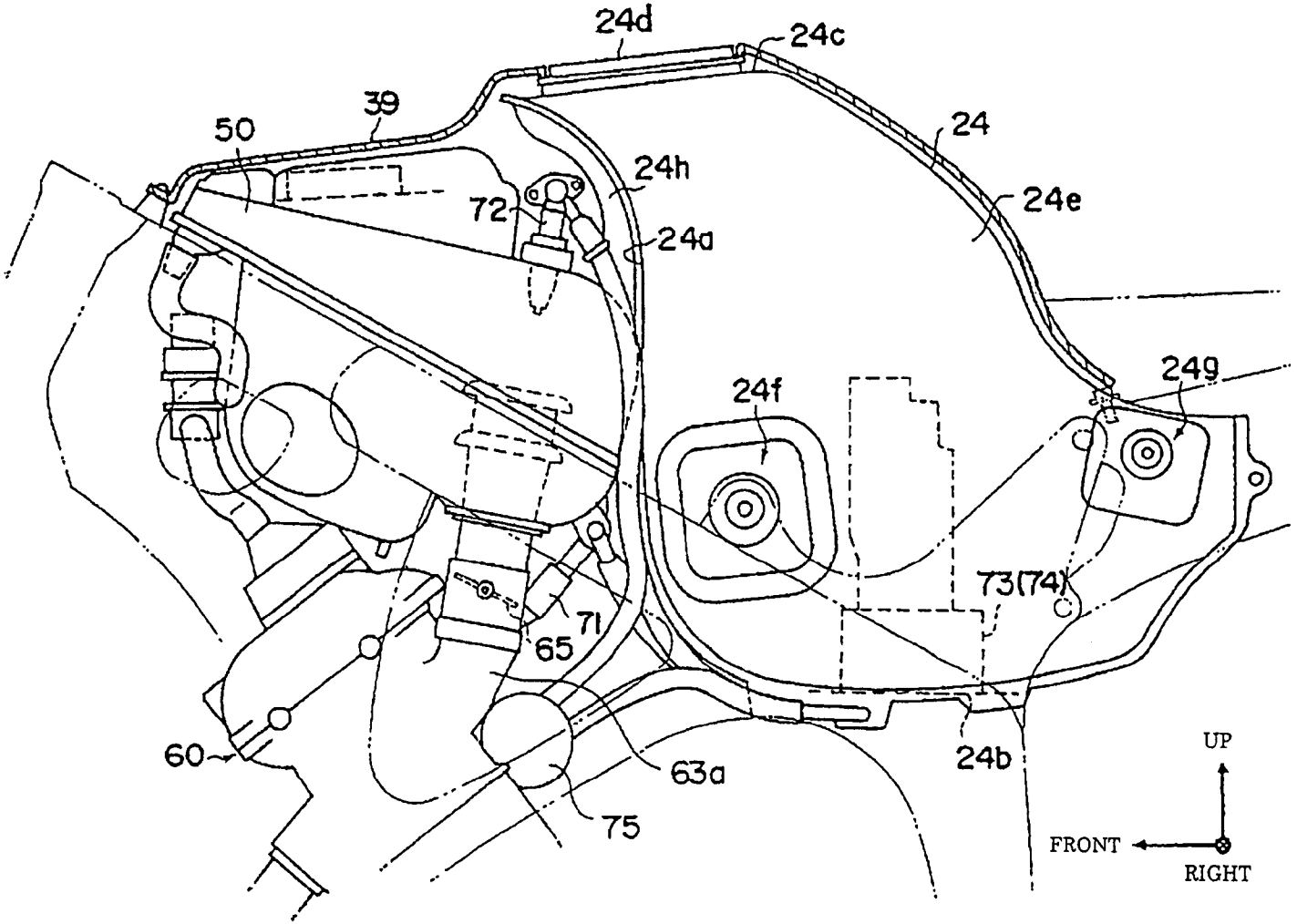
FIG. 2 is a left side elevation view of and around an engine, a fuel tank and an air chamber.

Next, a fuel injection system provided to the motorcycle 10 is described. As shown in FIG. 2, the air chamber 50 is provided above the engine 60. The fuel tank 24 is provided right behind the air chamber 50. The fuel tank 24 is includes a front wall 24*a* and a bottom plate 24*b*, which are nearly flat-shaped, an upper plate 24*c* having an oil filler port 24*d*, and a bottom portion having a fuel pump 73 (a first fuel pump 74). Moreover, mount portions 24*f* and 24*g* are provided to front and rear portions respectively of right and left plates 24*e* and the fuel tank 24 is mounted on the body frame 20 with the mount portions 24*f* and 24*g*.

As shown in FIG. 2, the upper surface of the fuel tank 24 is disposed at a position slightly higher than the upper surface of the air chamber 50. Only an upper portion of the front wall 24*a* is curved in a recessed shape in which the lower side thereof is recessed, and is slightly extended in the forward direction. An extended portion 24*h* thus formed covers only a rear upper portion of the air chamber 50. A cover 39 covers an upper half portion of the fuel tank 24 and an upper half portion of the air chamber 50, that is, a portion protruding in the upward direction from the body frame 20. This cover 39 is detachably attached to the body frame 20.

The engine 60 is, for example, a four-cylinder engine, and is provided with a fuel injection system 70. A throttle valve 65 is provided in an intake passage 63*a* (the intake passages 63*a* are aligned from the front side to the reverse side of the sheet of FIG. 2) of each of cylinders (cylinders) 61 (refer to FIG. 6). The throttle valve 65 regulates air quantity taken in the combustion chamber 62 (refer to FIG. 6) of the cylinder 61. Upper ends of the respective intake passages 63*a* are connected to the air chamber 50.

Figure 3:
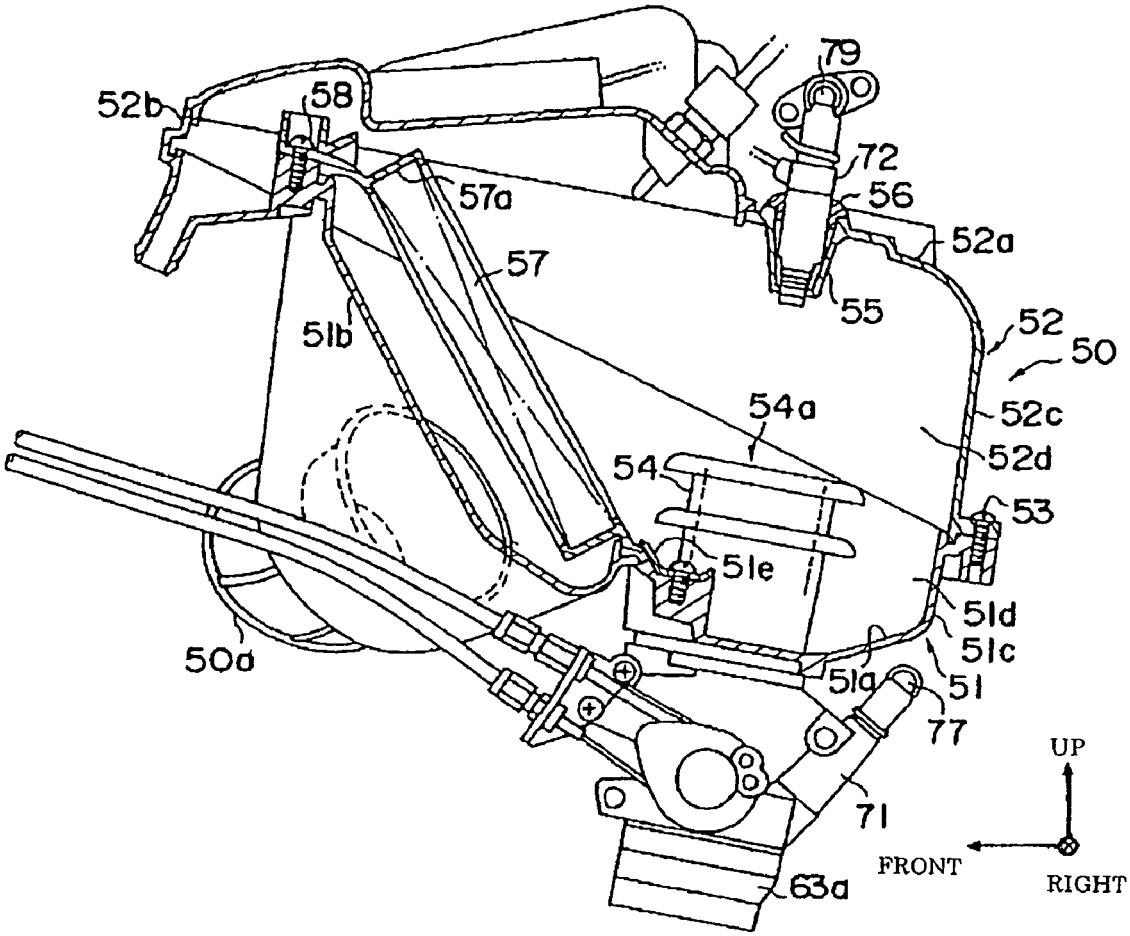
FIG. 3 is a sectional view of the above-described fuel injection system when viewed from the left side.

As shown in FIG. 3, the air chamber 50 is a resin molding consisting of two upper and lower separate portions that are a lower chamber 51 of the lower half portion and an upper chamber 52 of the upper half portion, respectively. In addition, the air chamber 50 is a container wherein the upper and lower portions are fixed to each other, for example, by using a plurality of screws 53. The lower chamber 51 is a container open in the upward direction, the container consists of a lower wall (a bottom plate) 51*a* which extends in a nearly horizontal direction, and which is connected to an upstream-side end of the intake passage 63*a*, a front wall (a front plate) 51*b* extending in the upward and forward direction from the front end of the lower wall 51*a*, a rear wall (a rear plate) 51*c* extending in the upward direction from the rear end of the lower wall 51*a*; and left and right side walls (side plates) 51*d*. The lower wall 51*a* is provided with a plurality of air pipes (funnels) 54 continued to respective upstream-side ends of the plurality of intake passages 63*a*. Ends of the plurality of air pipes 54 are formed to be open. Meanwhile, the upper chamber 52 is a container open in the downward direction, the container including an upper wall (a top plate) 52*a* extending in a way that the upper wall 52*a* faces the lower wall 51*a* and the front wall 51*b* of the lower chamber 51, a front wall (a front plate) 52*b* extending in the downward direction from the front end of the upper wall 52*a*; a rear wall (a rear plate) 52*c* extends in the downward direction from the rear end of the upper wall 52*a*; and right and left side walls (side plates) 52*d*.

Among walls forming the air chamber 50, the upper wall 52*a* is a wall facing the lower wall 51*a* connected to the upstream-side end of the intake passage 63*a*. A plurality of upstream-side fuel injection valves (to be described later) 72 are provided to the upper wall 52*a* such as above. From the plurality of upstream-side fuel injection valves, fuel is injected in the upstream-side ends of the respective intake passages 63*a*, i.e. openings 54*a* of the ends (upper ends) of the respective air pipes 54. For example, each of the upstream-side fuel injection valves 72 is attached to each of attaching members 55 made of metal. A clearance between the attaching member 55 and the upstream-side fuel injection valve 72 is filled with sealing member(s) (e.g., waterproof rubber grommets.) Thus, the upstream-side fuel injection valve 72 and the attaching member 55 are assembled as an assembling unit. Then, each of the attaching members 55 is attached to the upper wall 52*a* with, for example, nuts and bolts (not illustrated.)

The above-described air chamber 50 also serves as an air cleaner case. The air chamber 50 is provided with intake inlets 50*a* on the front right and front left sides of the lower chamber 51, and includes a flat-shaped filter element 57 in its own inside (intake outlets are the above-described air pipes 54). A frame body 57*a* of the filter element 57 is hooked, for example, on a hook portion (e.g., a set plate) 51*e* located at the lower end of the tilted front wall 51*b* of the lower chamber 51, and an upper end of the frame body 57*a* is fastened to the lower chamber 51 with, for example, a plurality of screws, etc. Thus, an inner space of the air chamber 50 is partitioned into first and second sides and the first side communicates with the intake inlet 50*a*, and the second side communicates with the air pipe 54.

Figure 4:
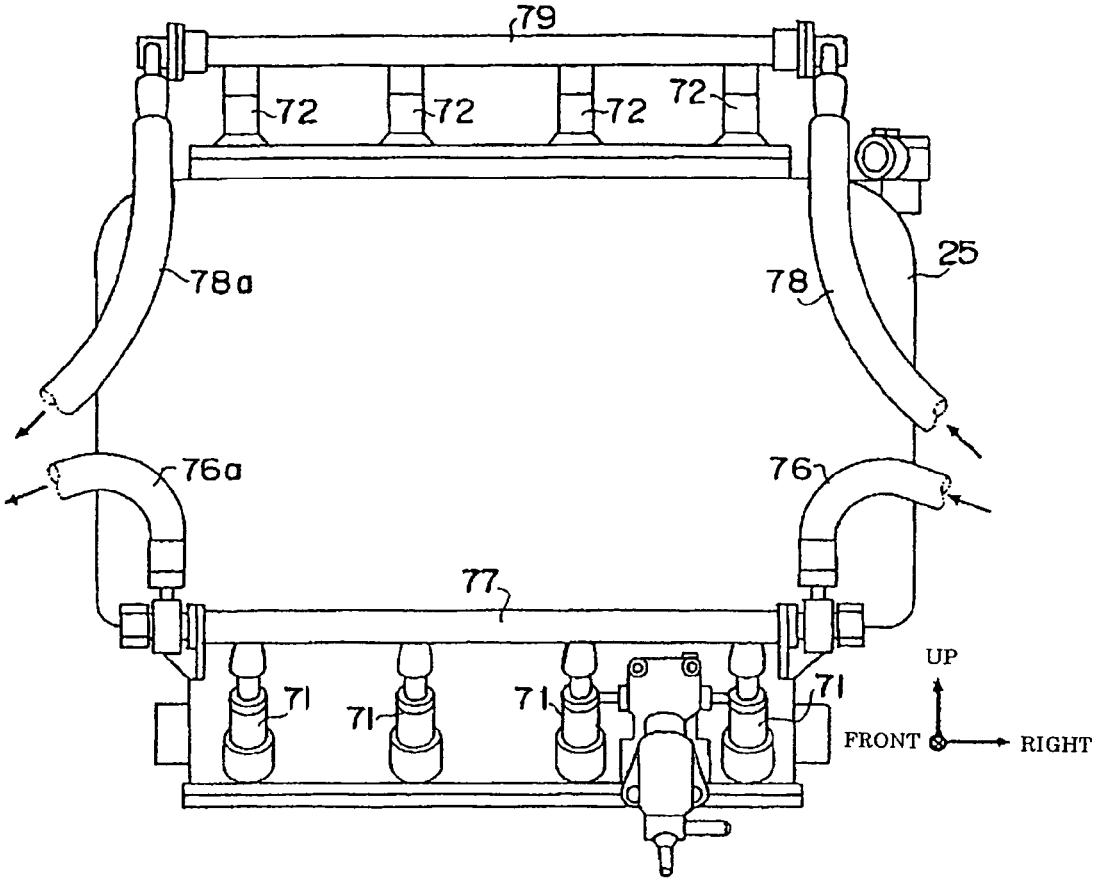
FIG. 4 is a rear side elevation view of the above-described fuel injection system.
Figure 5:
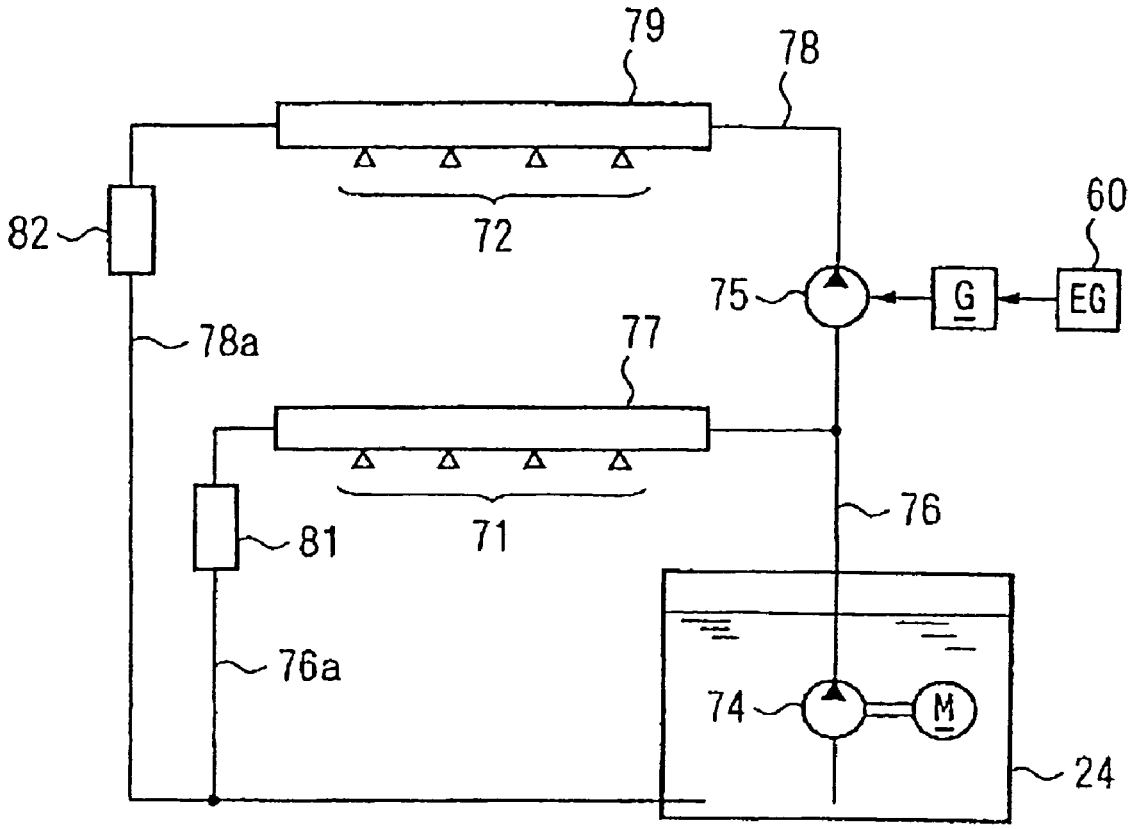
FIG. 5 is a schematic block diagram of the above-described fuel injection system.
Figure 6:
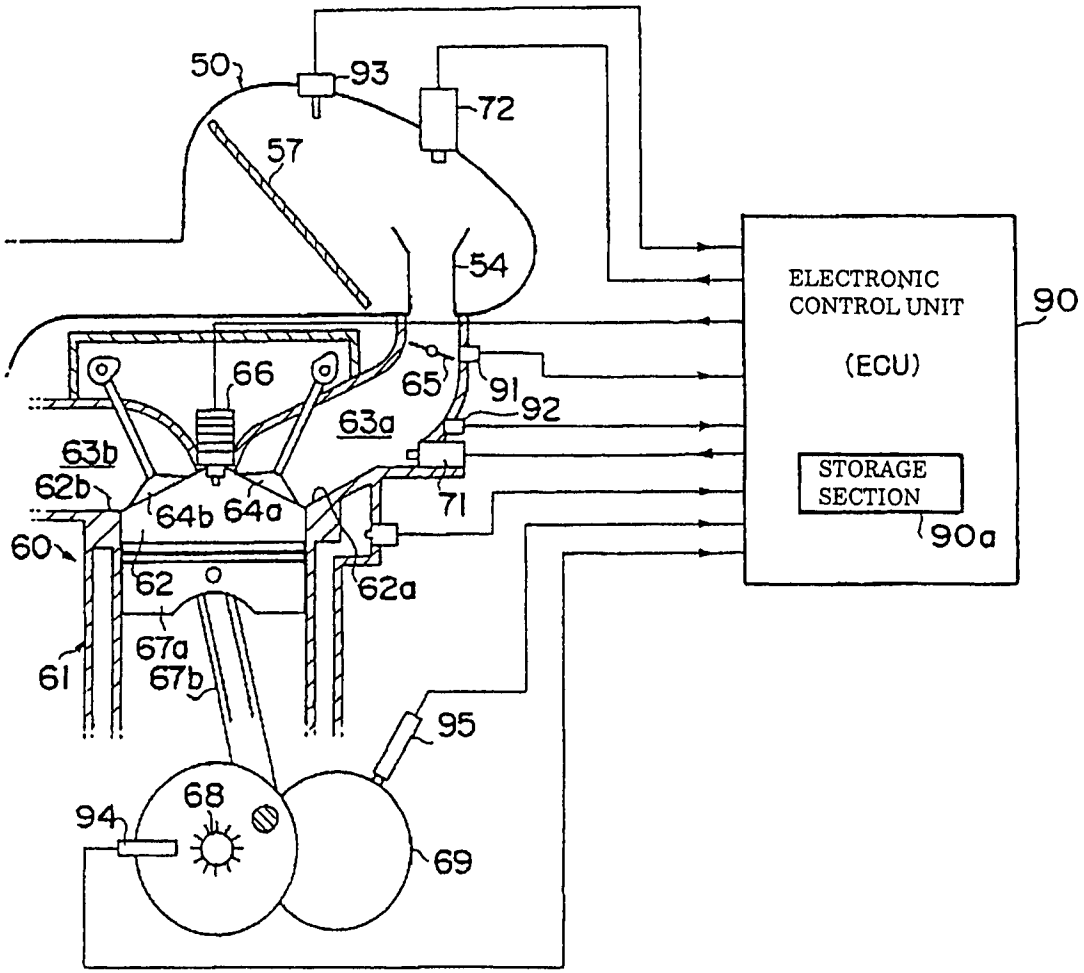
FIG. 6 is a schematic block diagram of and around a combustion chamber provided to each cylinder of the engine.

As shown in FIGS. 4 to 6, the fuel injection system 70 is configured by including four downstream-side fuel injection valves 71 each provided at a position on the downstream side of the throttle valve 65 in each of the intake passages 63*a* joined to each of the cylinders 61, four upstream-side fuel injection valves 72 provided in the air chamber 50 located on the upstream side of the throttle valve 65 in the respective intake passages 63*a*, the upstream-side fuel injection valves 72 corresponding to the respective cylinder 61, and the aforementioned fuel pump 73 which supplies fuel in the fuel tank 24 under pressure to the above four downstream-side fuel injection valves 71 and four upstream-side fuel injection valves 72. Each of the downstream-side fuel injection valves 71 is provided, obliquely extending in a forward and downward direction from a lower portion of a downstream-side delivery pipe 77 (refer to FIG. 4). The downstream-side delivery pipe 77 is provided, extending in the left to right direction (from the front side to the reverse side of the sheet of in FIG. 3) under the lower wall 51*a* of the lower chamber 51. Each of the upstream-side fuel injection valves 72 is provided, obliquely extending in the forward and downward direction from a lower portion of an upstream-side delivery pipe 79 (refer to FIG. 4). The upstream-side delivery pipe 79 is provided, extending in the left to right direction over the upper chamber 52.

As shown in FIG. 5, the fuel pump 73 consists of a first fuel pump 74 and a second fuel pump 75 provided inside and outside the fuel tank 24, respectively. The first fuel pump 74 is driven by an electric motor M provided inside the fuel tank 24, and supplies fuel (gasoline) in the fuel tank 24 under pressure to the downstream-side fuel injection valves 71 through a first fuel supply pipe 76 and the downstream-side delivery pipe 77 connected to the first fuel supply pipe 76. Furthermore, the second fuel pump 75 is driven mechanically via a gear train G driven by the engine 60. The second fuel pump 75 sucks up the fuel supplied under pressure to the downstream-side fuel injection valves 71 by the first fuel pump 74. Then, the second fuel pump 75 supplies the sucked-up fuel to the upstream-side fuel injection valves 72 through a second fuel supply pipe 78 and the upward-side delivery pipe 79 connected to the second fuel supply pipe 78. Here, a discharge pressure applied to the fuel by the first fuel pump 74 can be regulated to a predetermined and desired degree with a first regulator 81 provided to a fuel return pipe 76*a* through which the fuel returns from the downstream-side fuel injection valve 71. Meanwhile, a discharge pressure applied to the fuel by the second fuel pump 75 can be regulated to a predetermined and desired degree with a second regulator 82 provided to a fuel return pipe 78*a* through which the fuel returns from the upstream-side fuel injection valve 72. Incidentally, the second fuel pump 75 is not necessarily limited to the constitution in which the second fuel pump 75 is driven via the gear train G as described above. For example, it is possible to adopt a constitution of cam-follower-driven type in which the second fuel pump 75 is caused to perform a pumping operation by reciprocating a plunger (not illustrated) with a camshaft (not illustrated) that drives an intake valve 64*a* and an exhaust valve 64*b* described later. It is also possible to adopt a swash plate type, an electric-driven type or the like for the second fuel pump 75. However, depending on which type is adopted, a mounting position of the second fuel pump 75 on the engine may change (a mounting position of the second fuel pump 75 shown in FIG. 2 is an example).

As shown in FIG. 6, an intake port 62*a* and an exhaust port 62*b* are open to the combustion chamber 62. The intake valve 64*a* and the exhaust valve 64*b* are provided to the intake port 62*a* and the exhaust port 62*b*, respectively. A spark plug 66 is also provided to the combustion chamber 62. The foregoing intake passage 63*a* is connected to the intake port 62*a*, and the foregoing exhaust pipe 63*b* is connected to the exhaust port 62*b*. Moreover, in addition to a throttle opening degree sensor 91, a negative pressure sensor 92 is provided to the intake passage 63*a*. The throttle opening degree sensor 91 detects an opening degree of the throttle valve 65. The negative pressure sensor 92 detects an intake negative pressure. Furthermore, an intake heat sensor 93 is provided in the air chamber 50. The intake heat sensor 93 detects an intake (atmosphere) temperature.

An engine rpm sensor 94 is provided in a vicinity of a crankshaft 68 connected a piston 67*a* in each of the cylinders 61 through a connecting rod 67*b*. The engine rpm sensor 94 detects an engine rpm based on the rotation angle of the crankshaft 68. In addition, a speed sensor 95 is provided in a vicinity of a rotating body 69 such as a gear which is connected to the crankshaft 68 and rotated with the crankshaft 68. The speed sensor 95 detects a car speed. Moreover, a water temperature sensor 96 is provided to a water jacket formed on the cylinder 61. The water temperature sensor 96 detects the temperature of coolant water representing the temperature of the engine, An electronic control unit (ECU) 90 of the fuel injection system 70 outputs injection command signals to the downstream-side fuel injection valves 71 and the upstream-side fuel injection valves 72 based on information (signal) detected by the above-described sensors 91 to 96. These injection command signals are pulse signals each having a pulse width depending on the amount of injection. Both of the injection valves 71 and 72 are opened for a period of time corresponding to the respective pulse widths, and the fuel is injected from both of the injection valves 71 and 72. Thereafter, the spark plug 66 is ignited at fuel injection timing of both of the injection valves 71 and 72. Here, the electronic control unit 90 causes fuel to be injected from the downstream-side fuel injection valves 71 and the upstream-side fuel injection valves 72 on the respective fuel injection shares depending on the load on the engine 60. The load on the engine 60 is detected by an engine load detecting means consisting of the throttle opening degree sensor 91, the speed sensor 95, and the like (at least including the throttle opening degree sensor 91). Incidentally, the fuel injection share here denotes the ratio of the shared amount of fuel to the total amount of fuel to be supplied to the combustion chamber 62, the shared amount of fuel being injected by each of the downstream-side fuel injection valves 71 and the upstream-side fuel injection valves 72.

In the fuel injection system 70, the fuel injection pressure regulated by the second regulator 82 and applied to the upstream-side fuel injection valves 72 is set to be higher than that regulated by the first regulator 81 and applied to the downstream-side fuel injection valves 71. Accordingly, even through the distances between the upstream-side fuel injection valves 72 and the combustion chamber 62 are greater than those between the downstream-side fuel injection valves 71 and the combustion chamber 62, a time required for fuel injected from the upstream-side fuel injection valves 72 to reach the combustion chamber 62 can be made equal to or greater than a time required for fuel injected from the downstream-side fuel injection valves 71 to reach the combustion chamber 62. Thus, the fuel injection share of the upstream-side fuel injection valves 72 can be made greater than that of the downstream-side fuel injection valves 71, if necessary. This makes it possible, for example, to realize an engine having higher output than a conventional engine. Furthermore, the fuel injection pressure applied to the upstream-side fuel injection valves 72 can be increased. Thus, a required amount of fuel can be injected in a short time, and a variable region of a timing of fuel injection performed by the upstream-side fuel injection valves 72 can be enlarged. Accordingly, a great effect can be produced even in an engine provided with a variable valve timing system capable of varying an overlapped time when both of the intake valve 64*a* and the exhaust valve 64*b* are opened. In addition, since it is possible to atomize fuel injected by means of fuel injection under high pressure, volumetric efficiency and combustion efficiency can be enhanced. Consequently, a high output can be achieved.

Note that, it is possible to change, to respective desired degrees, the regulator pressure of the first regulator 81 (the fuel injection pressure applied to the downstream-side fuel injection valves 71), and the regulator pressure of the second regulator 82 (the fuel injection pressure applied to the upstream-side fuel injection valves 72). This is achieved with the electronic control unit 90 electronically controlling pressure variation parts (not shown) respectively of the first regulator 81 and the second regulator 82.

Moreover, as described above, in the fuel injection system 70, the electronic control unit 90 causes fuel to be injected from the downstream-side fuel injection valves 71 and the upstream-side fuel injection valves 72 on the respective fuel injection shares depending on the load on the engine 60 detected by the above-described engine load detecting means which detects the load on the engine 60. With this configuration, for example, it is possible to achieve higher output of the engine 60 by setting the fuel injection shares which produce high output efficiency. For example, the electronic control unit 90 stores, in its own storage section 90*a*, data on the fuel injection share of the upstream-side fuel injection valves 72 corresponding to the accelerator opening degree shown in FIG. 7, in advance. The electronic control unit 90 increases the fuel injection share of the upstream-side fuel injection valves 72, as the load (here, the accelerator opening degree) of the engine 60 detected by the engine load detecting means increases. For this reason, when the load is low, highly responsive fuel supply can be achieved by making larger the fuel injection share of the downstream-side fuel injection valves 71 whose distance to the combustion chamber 62 is small. Meanwhile, when the load is high, high output is produced by making larger the fuel injection share of the upstream-side fuel injection valves 72 having higher volumetric efficiency and combustion efficiency.

Figure 7:
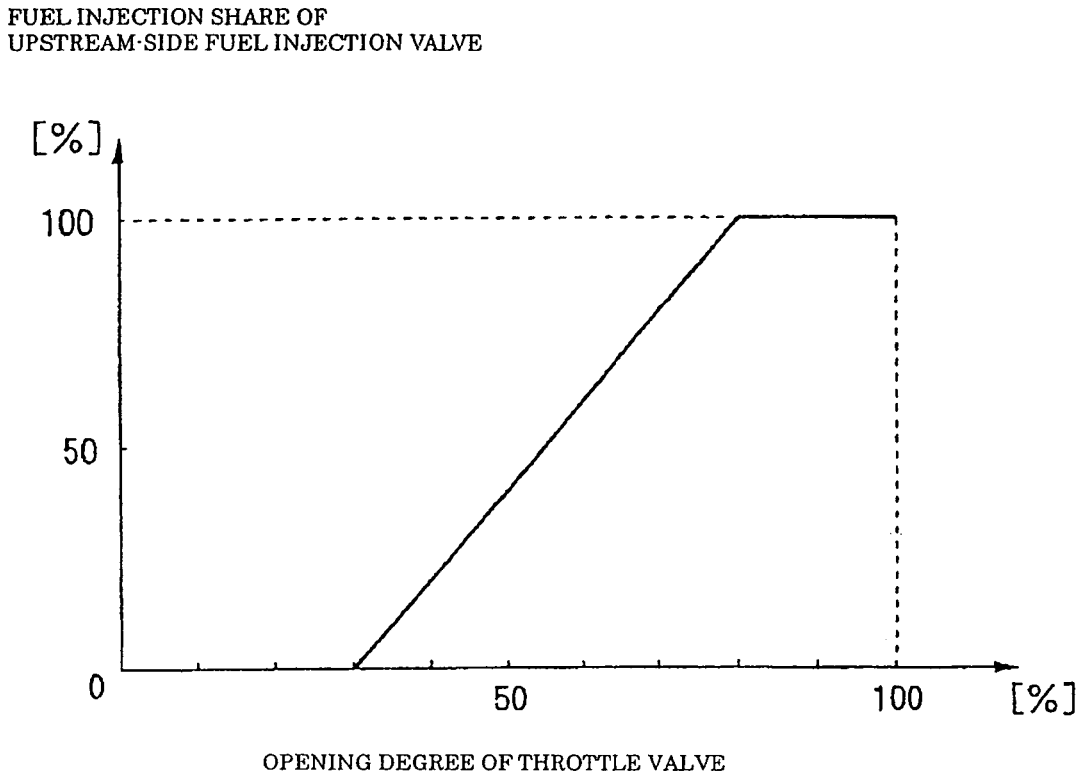
FIG. 7 is a view showing data (a graph) indicating a fuel injection share of an upstream-side fuel injection valve to a throttle opening degree, the data being stored in advance in a storage section of the electronic control unit.

According to data shown in FIG. 7, in the fuel injection system 70, the fuel injection share of the upstream-side fuel injection valves 72 is 0% in a low load domain where the accelerator opening degree is between 0% and 30%. The fuel injection share of the upstream-side fuel injection valves 72 increases monotonically from 0% to 100% in a middle load domain where the accelerator opening degree is within a range from 30% to 80%, as the accelerator opening degree increases (i.e., the engine load increases). Then, in a high load domain where the acceleration opening is within a range from 80 to 100%, the fuel injection share of the upstream-side fuel injection valves 72 is 100%. As described above, the fuel injection share of the upstream-side fuel injection valves 72 is set at 0% in a region of the throttle opening degree of the order of 0% to 30% including a fully closed state. With this setting, for example, it is not necessary to activate the second fuel pump 75 on a high pressure side when the engine 60 is at low load (e.g., at a time of starting the engine), that is, the amount of fuel to be supplied to the combustion chamber 62 is small. This makes it possible to enhance starting performance by saving the load (power), and to miniaturize a staring device itself. Furthermore, the fuel injection share of the upstream-side fuel injection valves 72 is set at 100% in a region of the throttle opening degree of the throttle valve 65 of the order of 80% to 100% including a fully open state. With this setting, the fuel is not injected from the downstream-side fuel injection valves 71 when the engine 60 is at high load. This results in enhancement of atomization performance, and increase of the output of the engine 60. In addition, when the engine 60 is at high load, the fuel injection pressure applied to the upstream-side fuel injection valves 72 is high. As a result, the fuel to be supplied to the combustion chamber 62 can be supplied in a sufficient amount only from the upstream-side fuel injection valves 72 to the combustion chamber 62.

Moreover, in the fuel injection system 70, the throttle valve 65 is disposed between the downstream-side fuel injection valve 71 and the upstream-side fuel injection valve 72 as shown in FIG. 6. In this configuration, the throttle valve 65 is disposed at a position close to the combustion chamber 62 as compared with a case where the throttle valve 65 is disposed in the intake passage 63 upstream of both of the injection valves 71 and 72. This configuration makes it possible to shorten the length of the intake passage, and to realize an engine with high output/high revolution rate. Since the fuel injection valves (the upstream-side fuel injection valves 72) are disposed upstream of the throttle valve 65, the atomization performance of fuel can be enhanced. As described above, the fuel injection share of the downstream-side fuel injection valves 71 is controlled to become large, when the opening degree of the throttle valve 65 is small. Accordingly, the flow of fuel is not blocked by the throttle valve 65. On the other hand, the fuel injection share of the upstream-side fuel injection valves 72 becomes large, when the opening degree of the throttle valve 65 is large. In this case, the flow of fuel is not blocked since the opening degree of the throttle valve 65 is also large.

As described above, the fuel pump 73 provided to the fuel injection system 70 includes the first fuel pump 74 which supplies fuel in the fuel tank 24 under pressure to the downstream-side fuel injection valves 71, and the second fuel pump 75 which supplies fuel to the upstream-side fuel injection valves 72, the fuel supplied under pressure to the downstream-side fuel injection valves 71 by the first fuel pump 74. Thus, the pressure at which the second fuel pump 75 finally supplies fuel is the sum of the supply pressure of the first fuel pump 74 and the supply pressure of the second fuel pump 75. This configuration can produce a high pressure required for the upstream-side fuel injection valve 75. Accordingly, for example, manufacturing cost can be lowered in comparison with a cost of manufacturing a high pressure pump including only the second fuel pump 75. In addition, in order to realize this configuration, it is sufficient to only add a pressure fuel pump corresponding to the second fuel pump 75 to a fuel injection system including only one fuel pump. Thus, existing fuel injection systems can be efficiently used.

Although the preferred embodiment of the present invention has been described, it is to be understood that the present invention is not limited to the above-described embodiment. For example, the data shown in FIG. 7 for the above-described embodiment merely shows one example. The point is that fuel may be injected from the downstream-side fuel injection valves 71 and the upstream-side fuel injection valves 72 on fuel injection shares depending on the load on the engine 60. Furthermore, the fuel injection share of the upstream-side fuel injection valves 72 may increase, as the load on the engine 60 increases. In addition, in the above-described embodiment, although an object to which the present invention is applied is the engine for a motorcycle, this is also only one example. The present invention can be applied to engines for a car and other types of power machinery.

I claim:

1. A fuel injection system for an engine, comprising:

a downstream-side fuel injection valve disposed in an intake passage connected to a combustion chamber of the engine, injecting fuel therein;

an upstream-side fuel injection valve disposed in the intake passage, upstream of said downstream-side fuel injection valve, injecting fuel into the intake passage; and a fuel pump for supplying the fuel under pressure to the downstream-side fuel injection valve and the upstream-side fuel injection valve is provided in the fuel injection system, wherein a fuel injection pressure applied to said upstream-side fuel injection valve is set at a higher value than a fuel injection pressure applied to said downstream-side fuel injection valve; and wherein the fuel pump comprises a first fuel pump which supplies the fuel in a fuel tank under pressure to the downstream-side fuel injection valves; and a second fuel pump which supplies the fuel via the first fuel pump under pressure to the upstream-side fuel injection valve.

2. The fuel injection system for an engine according to claim 1, further comprising:

control means for controlling injections of fuel performed respectively by said downstream-side fuel injection valve and said upstream-side fuel injection valve; and engine load detecting means for detecting a load on the engine, wherein said control means causes fuel to be injected respectively from said downstream-side fuel injection valve and said upstream-side fuel injection valve respectively, on fuel injection shares depending on the load on the engine which is detected by said engine load detecting means.

3. The fuel injection system for an engine according to claim 2, wherein said control means increases the fuel injection share of the upstream-side fuel injection valve, as the load on the engine detected by said engine load detecting means increases.

4. The fuel injection system for an engine according to claim 3, further comprising:

a throttle valve, disposed in the intake passage, which regulates an amount of air to be taken into the combustion chamber; and throttle opening degree detecting means for detecting an opening degree of said throttle valve, wherein said engine load detecting means includes at least said throttle opening degree detecting means, and said control means sets the fuel injection share of the upstream-side fuel injection valve at 0% when said throttle opening degree detecting means detects that said throttle valve is in a fully closed state.

5. The fuel injection system for an engine according to claim 3, further comprising:

a throttle valve disposed in the intake passage, which regulates an amount of air to be taken into the combustion chamber; and a throttle opening degree detecting means for detecting an opening degree of said throttle valve, wherein said engine load detecting means includes at least said throttle opening degree detecting means, and said control means sets the fuel injection share of said upstream-side fuel injection valve at 100% when said throttle opening degree detecting means detects that the throttle valve is in a fully open state.

6. The fuel injection system for an engine according to claim 4, wherein said throttle valve is disposed between said downstream-side fuel injection valve and said upstream-side fuel injection valve.

7. The fuel injection system for an engine according to claim 5, wherein said throttle valve is disposed between said downstream-side fuel injection valve and said upstream-side fuel injection valve.

* * * * *